US006058584A

United States Patent [19]

Matsuyama et al.

[11] Patent Number: 6,058,584

[45] Date of Patent: May 9, 2000

[54] APPARATUS FOR INCREASING THE SURFACE STRENGTH OF METAL COMPONENTS

[75] Inventors: Taizo Matsuyama, Sayama; Hiroshi Honda, Tsurugashima; Koji Ujihashi, Tokorozawa; Takashi Ogawa, Sayama, all of Japan

[73] Assignee: Honda Giken Kabushiki Kaisha, Tokyo, Japan

[21] Appl. No.: 08/944,872

[22] Filed: Oct. 6, 1997

[30] Foreign Application Priority Data

| | | | |
|---|---|---|---|
| Oct. 11, 1996 | [JP] | Japan | 8-270364 |
| Oct. 11, 1996 | [JP] | Japan | 8-270368 |
| Oct. 11, 1996 | [JP] | Japan | 8-270369 |

[51] Int. Cl.[7] ..... B24B 39/00

[52] U.S. Cl. ..... 29/90.7; 451/89; 134/80

[58] Field of Search ..... 29/90.7; 451/89, 451/82, 75; 134/80; 15/301, 303, 306.1

[56] References Cited

FOREIGN PATENT DOCUMENTS

| | | |
|---|---|---|
| 521711 | 4/1987 | Japan . |
| 873930 | 3/1996 | Japan . |
| 695764 | 8/1953 | United Kingdom . |

*Primary Examiner*—David P. Bryant
*Assistant Examiner*—Jermie E. Cozart
*Attorney, Agent, or Firm*—Birch, Stewart, Kolasch & Birch, LLP

[57] ABSTRACT

A casing has a processing chamber and a drying chamber defined therein by a partition mechanism. The processing chamber houses an impelling mechanism for impelling a mixed stream of glass beads and water toward a gear. First and second drying mechanisms are successively brought into the drying chamber by the partition mechanism. While the gear is being processed, i.e., peened, by the impelling mechanism in the processing chamber, a previously processed gear is dried in the drying chamber. Gears can quickly and efficiently be peened, washed, and dried successively in the casing.

14 Claims, 15 Drawing Sheets

APPARATUS FOR INCREASING THE SURFACE STRENGTH OF METAL COMPONENTS

BACKGROUND OF THE PRESENT INVENTION

1. Field of the Invention

The present invention relates to an apparatus for increasing the strength of a surface of metal components.

2. Description of the Related Art

Some metal components, such as gears, are required to have their surfaces improved for fatigue strength because they are subject to repetitive loads in use. One known process of hardening the surface of gears is a shot peening process which blasts the gear surface with steel balls or the like to give compressive residual stresses to the gear surface.

The conventional shot peening process which employs hard steel balls is disadvantageous in that the hard steel balls tend to roughen the gear surface, lowering the smoothness thereof. Another known shot peening process, which is disclosed in Japanese patent publication No. 5-21711, applies glass beads having diameters ranging from 0.2 to 0.6 mm to the surface of metal parts. One problem of the disclosed shot peening process is that the glass beads are ejected in a poor directivity pattern, i.e., ejected in various different directions, and hence are not used efficiently.

There has been proposed a method of increasing the strength of the surface of metal components for reliably improving surface roughness and fatigue strength thereof with increased working efficiency, as disclosed in Japanese laid-open patent publication No. 8-73930. According to the proposed method, a liquid mixed with glass beads is applied to a metal component to increase the toughness of its surface. Because the glass beads are mixed with the liquid, the glass beads are impelled in a desired directivity pattern to strike a desired surface area of the metal component, which is hardened into an improved surface layer kept under residual compression.

According to the conventional shot peening processes, metal components are peened in a processing chamber. Immediately after a metal component is peened in the processing chamber, a mist containing crushed fragments of the glass beads is suspended in the processing chamber. In order to prevent the mist from flowing out of the processing chamber, it is necessary to remove the processed metal component from the processing chamber a predetermined period of time after the metal component has been peened. This practice has made a peening cycle time considerably long.

The peened metal component needs to be washed to remove crushed glass bead debris therefrom, and thereafter to be dried for rust prevention. These washing and drying steps that are individually carried out following the peening process are another factor that also makes the entire cycle time longer.

The glass beads are usually stored in a hopper and fed at a certain rate to an impelling nozzle through a tube that interconnects the hopper and the impelling nozzle.

Since the hopper is disposed in a relatively high position above the nozzle, the rate at which the glass beads are supplied from the hopper to the nozzle is liable to vary depending on the quantity of glass beads stored in the hopper. The varying rate prevents glass beads from being applied at a constant rate to metal parts, with the result that the metal parts cannot be blasted with the stable shot for desired surface strength.

The hopper installed in the high position also prevents itself from increasing its volume in an upward direction because of limitations imposed on the worker who handles the hopper for replenishing it with glass beads, servicing the hopper, etc. As a consequence, the volume of the hopper cannot be increased as desired.

The nozzle for impelling the liquid mixed with glass beads is positioned relatively closely to the metal component that is held in a blasting station because of the need to apply the mixed stream of the liquid and glass beads reliably to a desired surface area of the metal component.

When a metal component is automatically taken into and out of the blasting station by a feed mechanism, the feed mechanism may possibly be brought into physical interference with the impelling nozzle. To avoid such physical interference, it is necessary to additionally provide a mechanism for positioning the impelling nozzle with respect to the metal component and a mechanism for moving the impelling nozzle to a position out of physical interference with the feed mechanism. As a result, the overall facility for shot peening is complex and large in size.

SUMMARY OF THE INVENTION

It is a general object of the present invention to provide an apparatus for increasing the strength of the surface of metal components in a quick and efficient process while reliably preventing a mist from flowing out of a processing chamber.

A major object of the present invention to provide an apparatus for increasing the strength of the surface of metal components, the apparatus having an impelling mechanism for impelling a mixed stream of glass beads and a liquid, and a mechanism for supplying glass beads at an accurate rate to the impelling mechanism and increasing a storage volume for glass beads.

Another object of the present invention to provide an apparatus for increasing the strength of the surface of metal components, the apparatus having a simple mechanism for positioning an impelling nozzle with respect to a metal component and moving the impelling nozzle accurately to a position out of physical interference with the metal component as it is fed.

The above and other objects, features, and advantages of the present invention will become apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
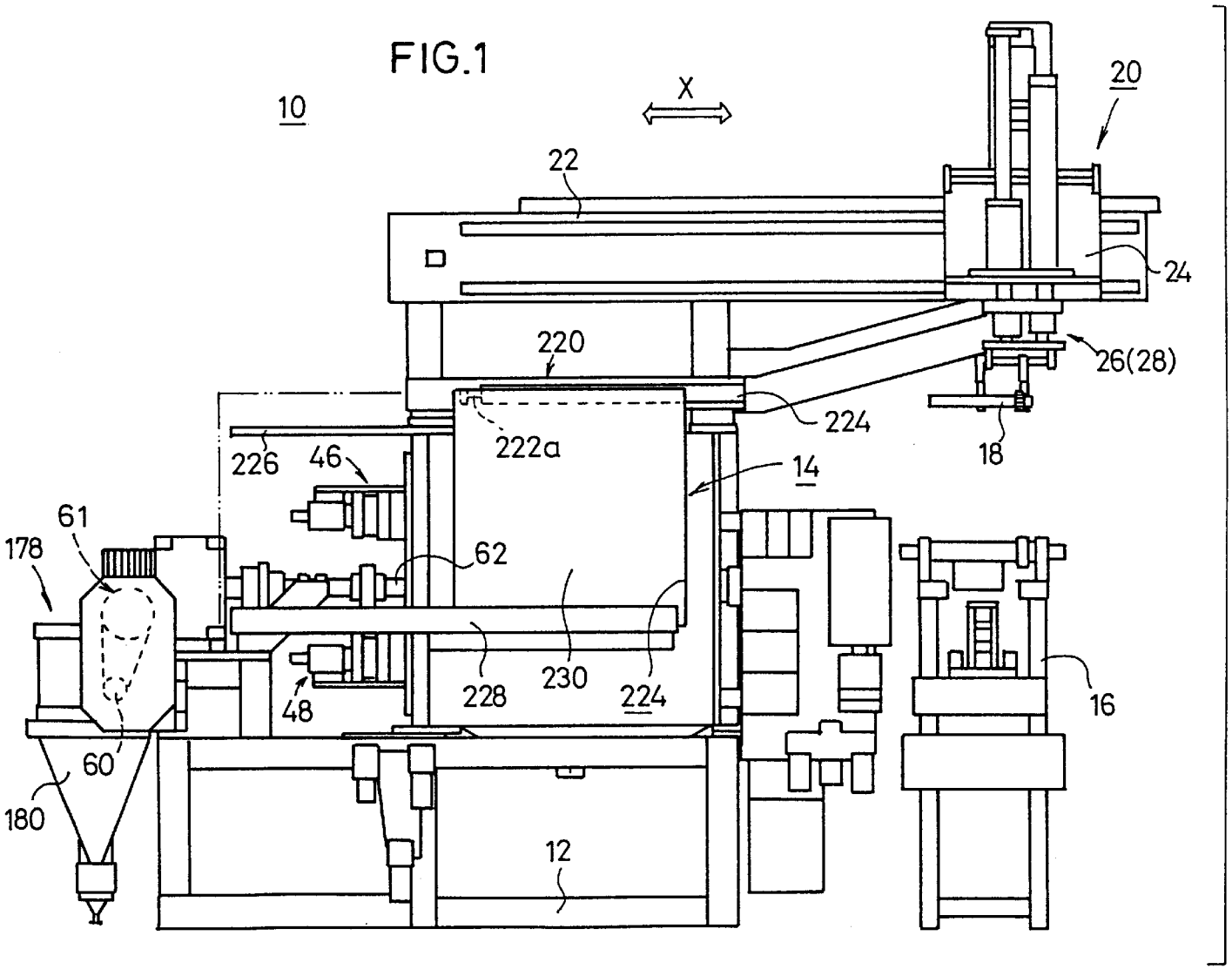
FIG. 1 is a front elevational view of an apparatus for increasing the strength of the surface of metal components according to the present invention.
Figure 2:
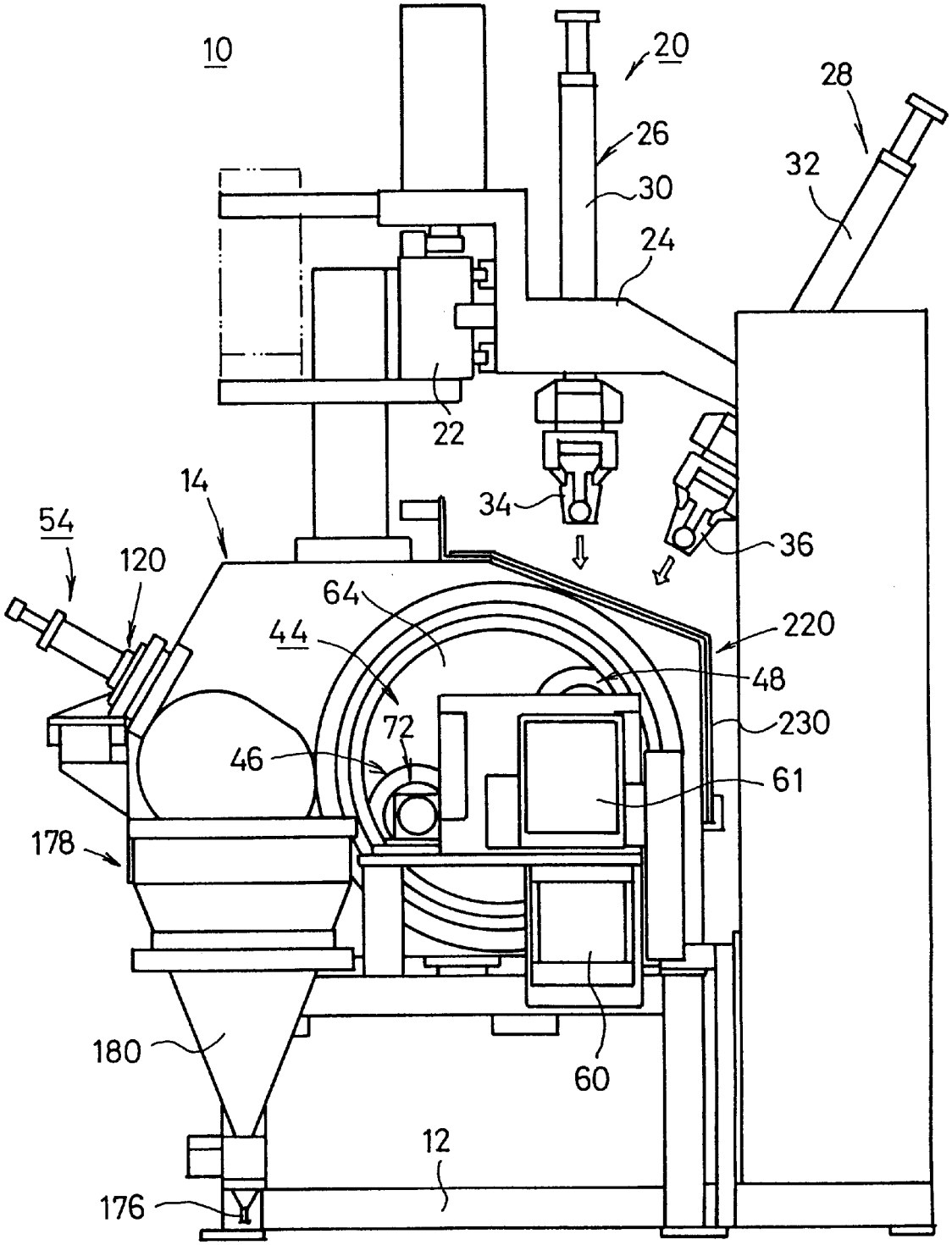
FIG. 2 is a side elevational view of the apparatus.
Figure 3:
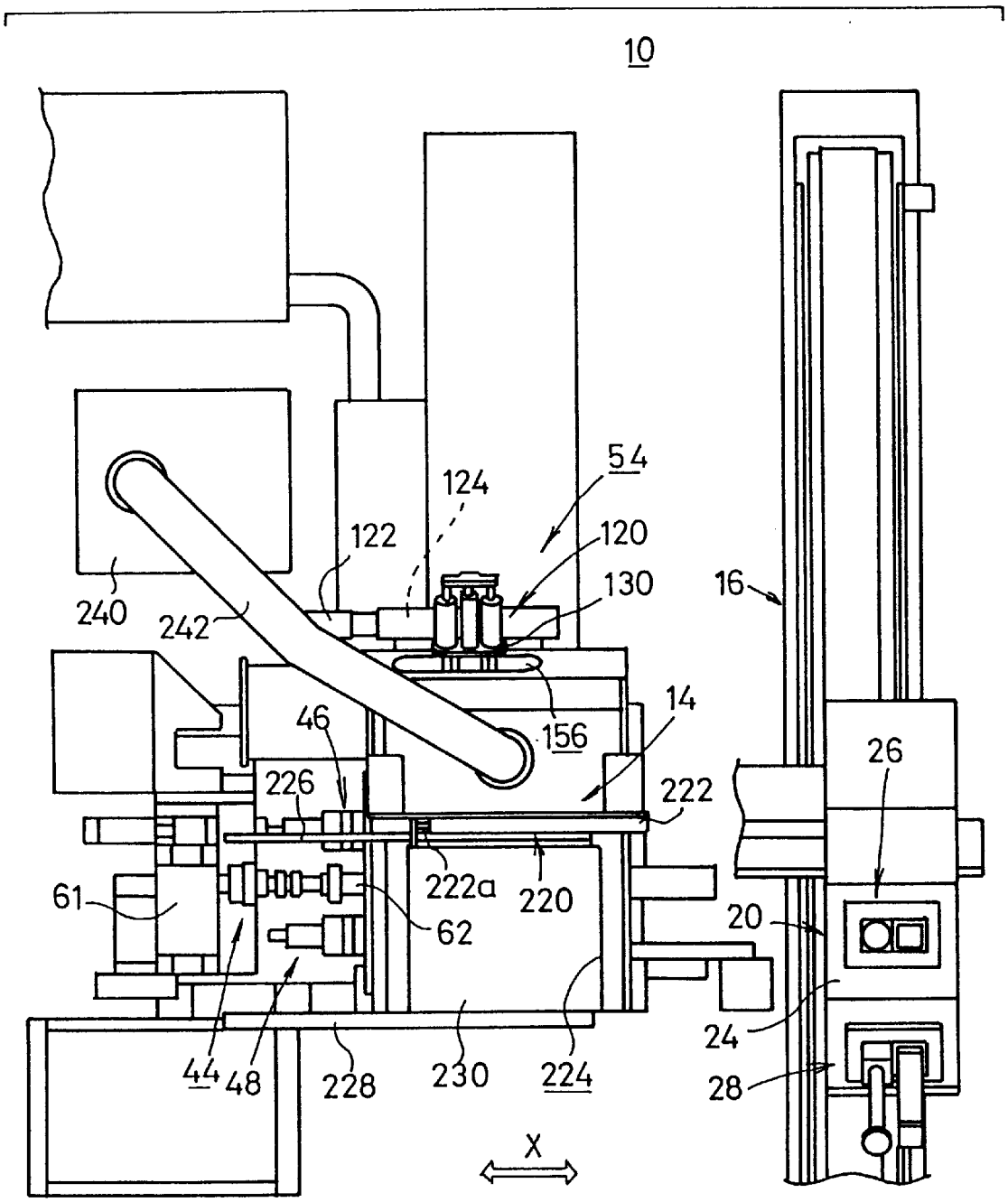
FIG. 3 is a plan view of the apparatus.
Figure 4:
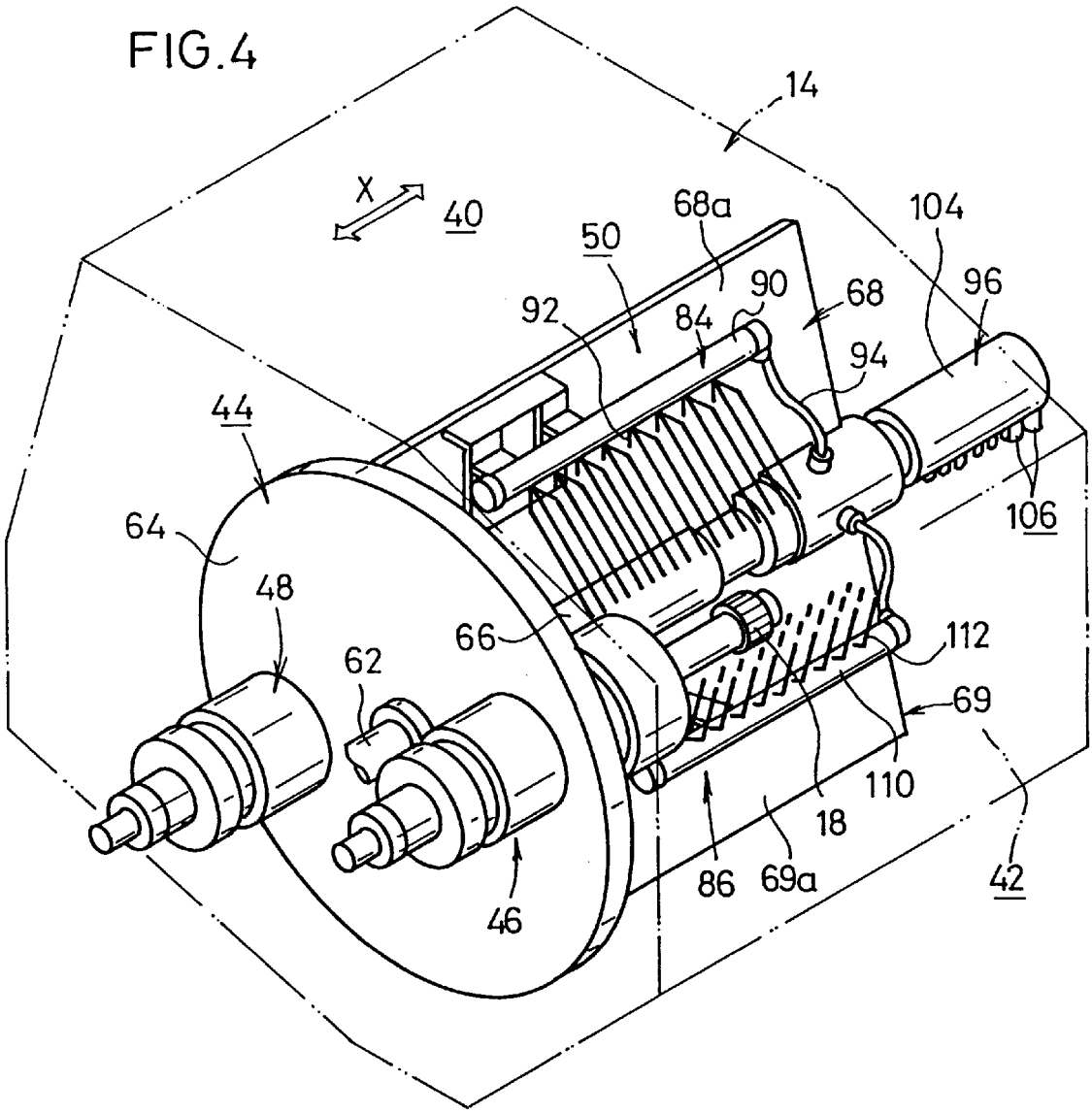
FIG. 4 is a perspective view of a casing of the apparatus and mechanisms housed in the casing.

As shown in FIGS. 1 through 3, an apparatus 10 for increasing the strength of the surface of metal components according to the present invention has a casing 14 supported on a base 12, a workpiece conveyor 16 spaced from the casing 14, and a feed mechanism 20 positioned between the casing 14 and the workpiece conveyor 16 for feeding a metal component to be processed, such as a gear 18, between the casing 14 and the workpiece conveyor 16.

The feed mechanism 20 has guide rails 22 supported on the casing 14 and extending in the direction indicated by the arrow X perpendicular to the workpiece conveyor 16, and a self-propelled slide base 24 reciprocally movably mounted on the guide rails 22. On the slide base 24, there are mounted a charger 26 that extends vertically and a discharger 28 that extends obliquely to the vertical direction. The charger 26 and the discharger 28 have on their lower ends respective charging and discharging grippers 34, 36 that are movable back and forth by respective cylinders 30, 32. The charging and discharging grippers 34, 36 can be moved into a drying chamber (described later on) disposed in the casing 14.

As shown in FIGS. 4 through 7, the casing 14 houses therein a partition mechanism (feed mechanism) 44 which divides the interior space of the casing 14 into a processing chamber 40 and a drying chamber 42, first and second holder mechanisms 46, 48 mounted on the partition mechanism 44 for positioning and holding the gear 18 in a blasting station Si and a drying station S2, first and second drying mechanisms 50, 52 mounted on the partition mechanism 44 for being placed alternately in the processing chamber 40 and the drying chamber 42, an impelling mechanism 54 and a washing liquid supply mechanism 56 which are disposed in the processing chamber 40, and a fixed drying mechanism 58 disposed in the drying chamber 42.

Figure 5:
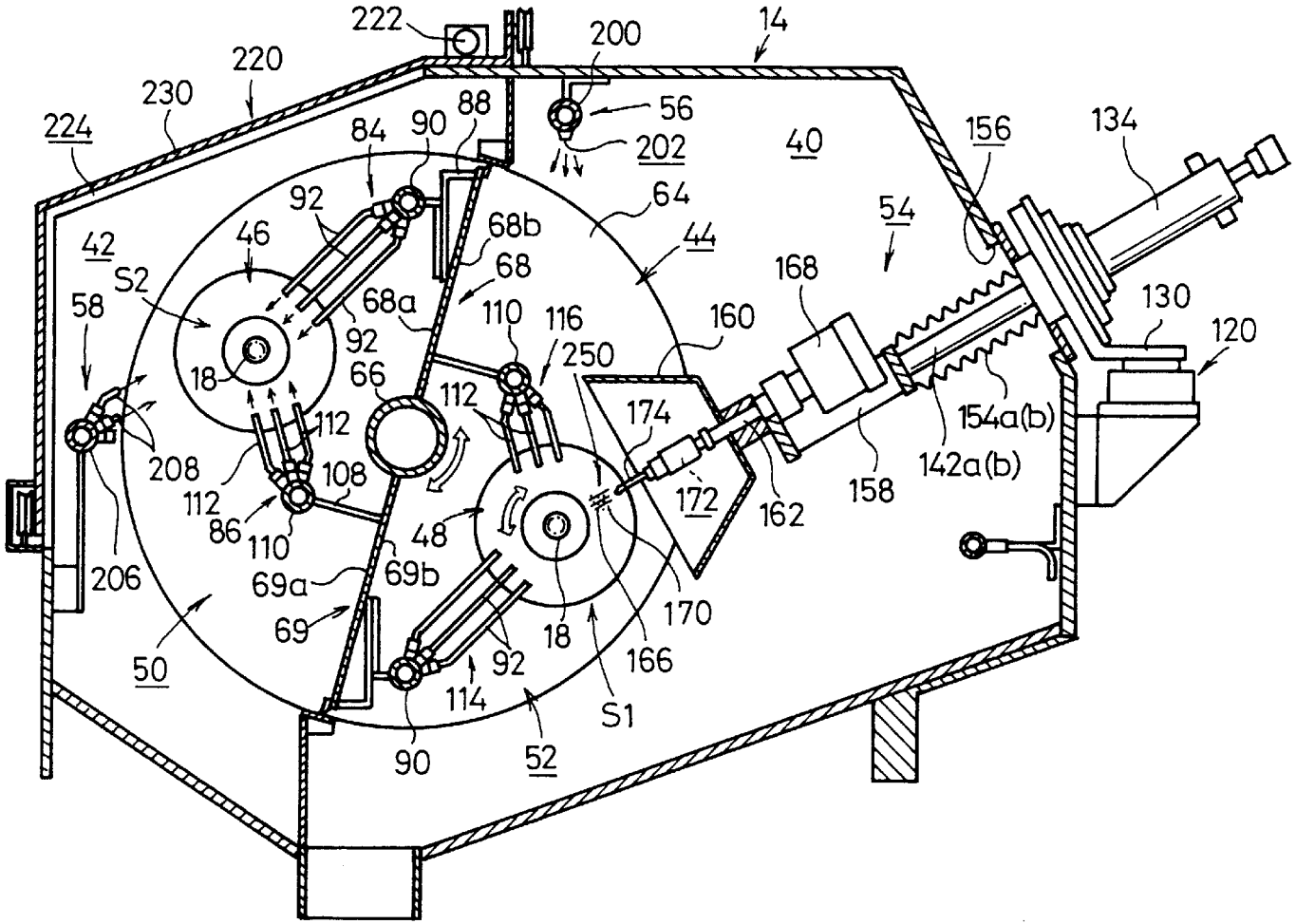
FIG. 5 is a vertical cross-sectional view of the casing and the mechanisms housed therein.
Figure 6:
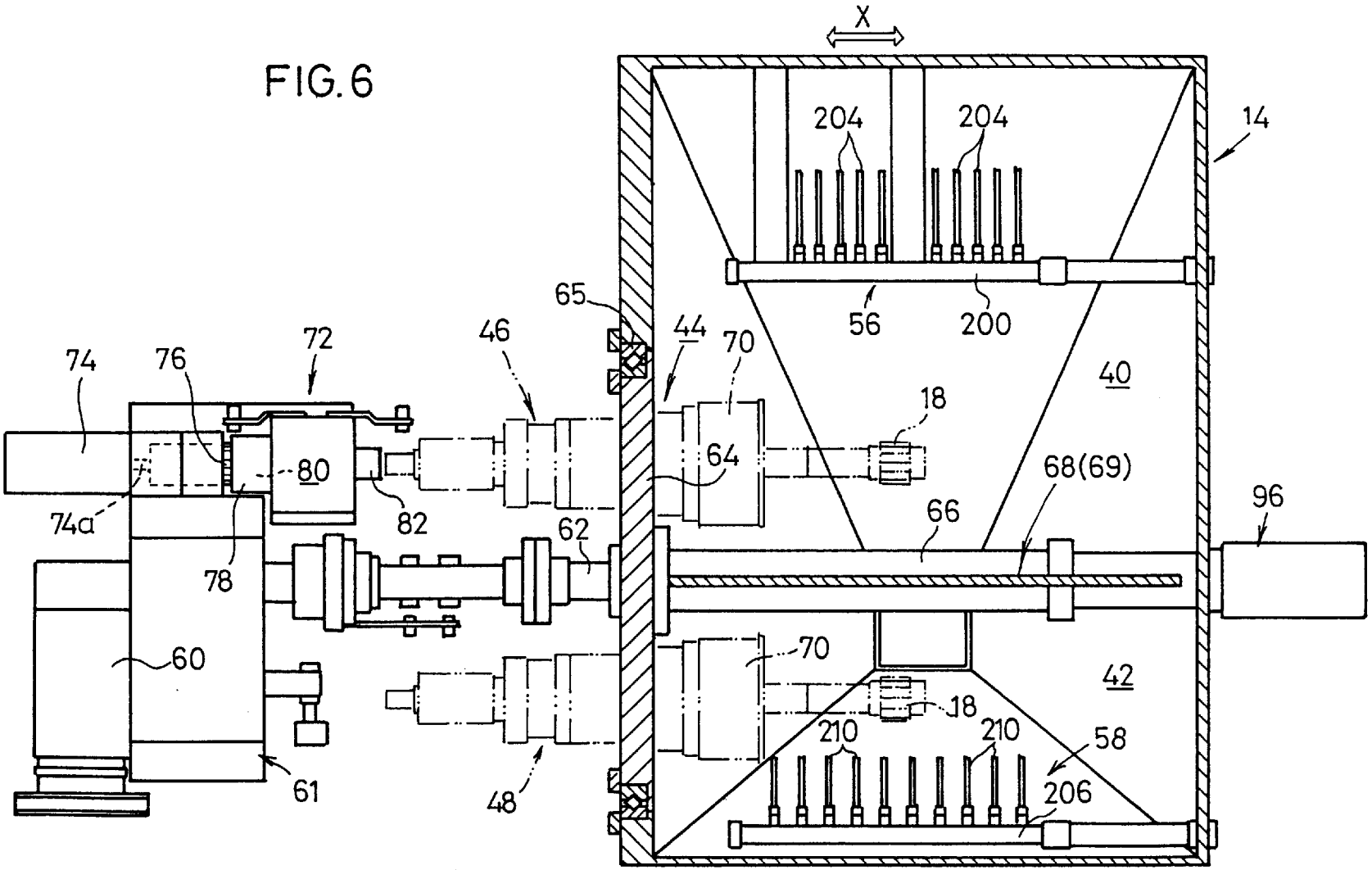
FIG. 6 is a sectional plan view of the casing and the mechanisms housed therein.
Figure 7:
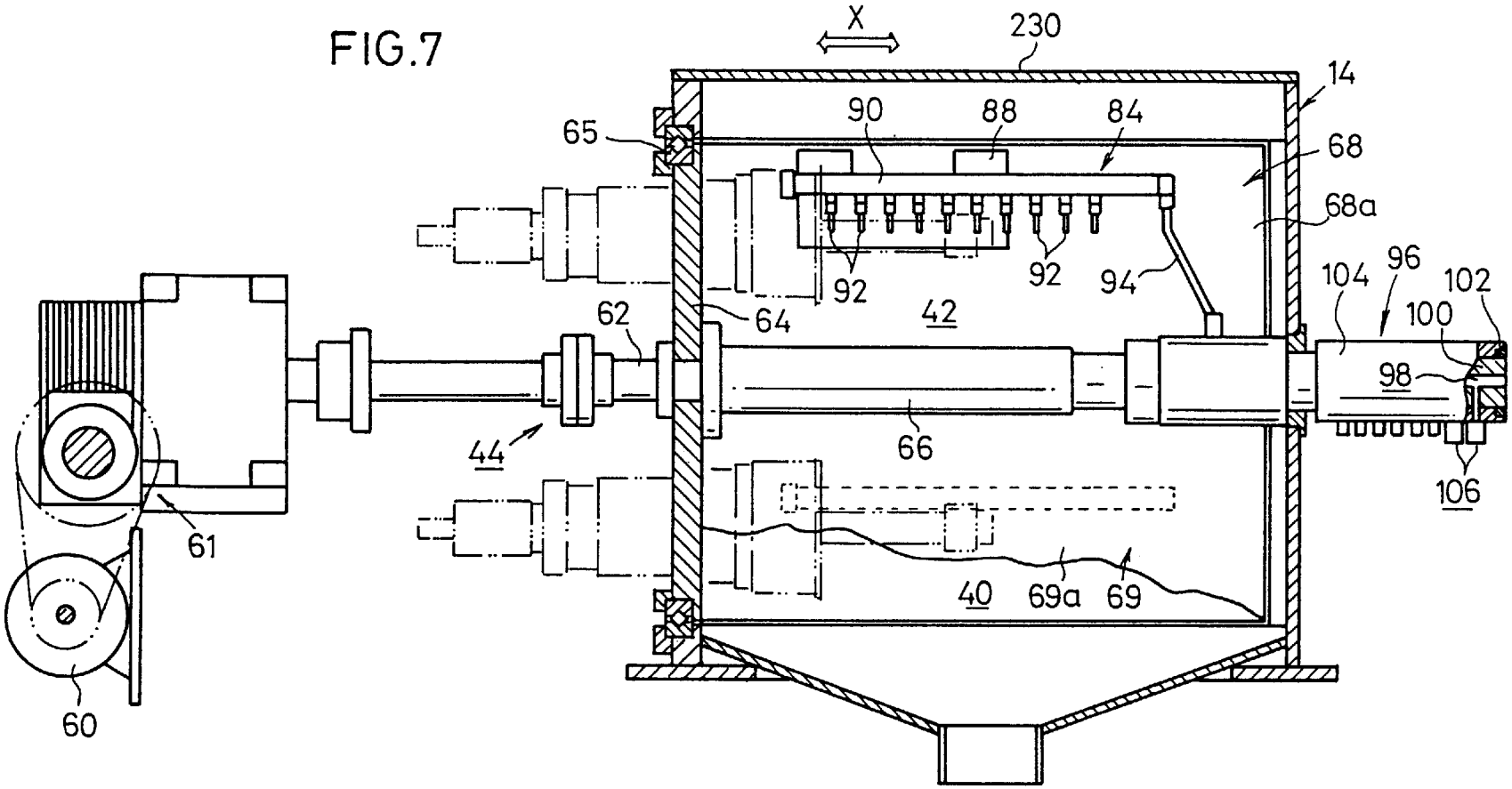
FIG. 7 is sectional front elevational view of the casing and the mechanisms housed therein.

As shown in FIGS. 2, 6, and 7, the partition mechanism 44 includes a motor 60 located outside of the casing 14 and a rotatable shaft 62 operatively coupled to the motor 60 through a transmission mechanism 61 which includes a belt, pulleys, and a gear train. The rotatable shaft 62 is fixedly mounted on a turn disk (turn member) 64 which is rotatably supported on an end wall of the casing 14 by a bearing 65. A shaft 66 is mounted at one end thereof on the turn disk 64 coaxially with the rotatable shaft 62 and extends in the casing 14. The shaft 66 supports a pair of partition plates 68, 69 (see FIG. 5) that extend radially outwardly from the shaft 66 and are housed in the casing 14.

The first and second holder mechanisms 46, 48 are supported on the turn disk 64 at respective positions that are symmetrically spaced radially outwardly from the central axis of the turn disk 64. As shown in FIG. 6, the first and second holder mechanisms 46, 48 have respective holders 70 for removably holding the gear 18. An actuator mechanism 72 is located outside of the casing 14 for selective connection to the first holder mechanism 46 or the second holder mechanism 48 in the processing chamber 40 for rotating the gear 18 held thereby in the processing chamber 40.

The actuator mechanism 72 has a rotary actuator 74 having a drive shaft 74*a* that is connected to a splined shaft 76. The splined shaft 76 is held in mesh with keys (not shown) formed on an inner circumferential surface of a piston 78 in a cylinder. The piston 78 thereby defines a coupling 80 on its tip end which can be connected to a rotatable shaft of one at a time of the first and second holder mechanisms 46, 48.

As shown in FIG. 5, the first drying mechanism 50 has first and second drying air supplies 84, 86 mounted on surfaces 68*a*, 69*a*, respectively, of the partition plates 68, 69.

As shown in FIGS. 5 and 7, the first drying air supply 84 has a pipe 90 fixed to the surface 68*a* of the partition plate 68 by an attachment 88 and extending parallel to the shaft 66, and a plurality of air nozzles 92 connected to the pipe 90 and spaced axially along the pipe 90 in the direction indicated by the arrow X, the air nozzles 92 being arranged in three arrays spaced in a circumferential direction of the pipe 90. Each of the air nozzles 92 is directed toward the gear 18 that is placed in the drying chamber 42.

As shown in FIG. 7, the pipe 90 has an end connected to an end of an air supply pipe 94 whose other end is coupled to an air switching unit 96 that is mounted on the other end of the shaft 66 which is positioned outside of the casing 14. The air switching unit 96 comprises a rotary member 100 rotatable in unison with the shaft 66 and having an air passage 98 defined therein in communication with the air supply pipe 94, and a fixed member 104 disposed around the rotary member 100 through a bearing 102. The fixed member 104 has air ports 106 connected to an air supply (not shown). Only when the first drying air supply 84 is placed in the drying chamber 42, drying air is supplied from the air supply through the air ports 106, the air passage 98, the air supply pipe 94 to the first drying air supply 84.

The second drying air supply 86 is of substantially the same structure as the first drying air supply 84. As shown in FIG. 5, the second drying air supply 86 has a pipe 110 fixed to the surface 69*a* of the partition plate 69 by an attachment 108 and extending parallel to the shaft 66, and a plurality of air nozzles 112 connected to the pipe 110 and spaced axially along the pipe 110 in the direction indicated by the arrow X, the air nozzles 112 being arranged in three arrays spaced in a circumferential direction of the pipe 110. Each of the air nozzles 112 is directed toward the gear 18 that is placed in the drying chamber 42. The pipe 110 is coupled to the air passage 98 in the rotary member 100 of the air switching unit 96. Only when the second drying air supply 86 is placed in the drying chamber 42, the second drying air supply 86 is supplied with drying air from the air supply through the air switching unit 96.

The second drying mechanism 52 has first and second drying air supplies 114, 116 mounted on surfaces 68*b*, 69*b*, respectively, of the partition plates 68, 69. The first and second drying air supplies 114, 116 are identical in structure to the first and second drying air supplies 84, 86, respectively. Those parts of the first and second drying air supplies 114, 116 which are identical to those of the first and second drying air supplies 84, 86 are designated by identical reference characters, and will not be described in detail below.

The first and second drying air supplies 114, 116 are supplied with drying air only from the air supply through the air switching unit 96 when they are placed in the drying chamber 42.

Figure 8:
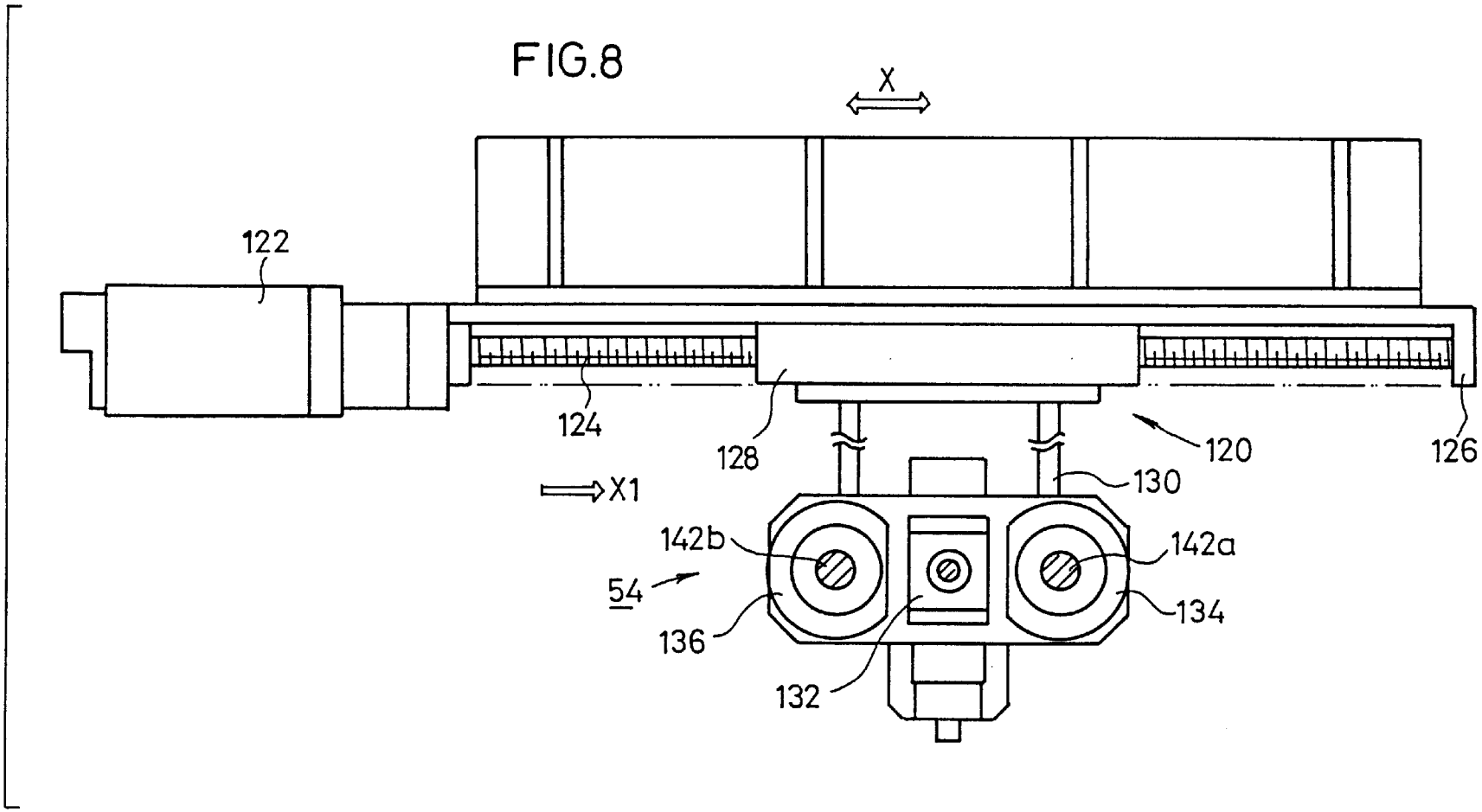
FIG. 8 is a plan view of an impelling mechanism of the apparatus.

As shown in FIGS. 3 and 8, the impelling mechanism 54 has a slide unit 120 movable axially of the gear 18 in the direction indicated by the arrow X which is perpendicular to the direction (impelling direction) in which a mixture of water and glass beads is impelled. The slide unit 120 comprises a motor 122 fixed to an outer surface of the casing 14 and a ball screw 124 coaxially connected to the drive shaft of the motor 122. The ball screw 124 is rotatably supported by a support 126 (see FIG. 8) fixed to the outer surface of the casing 14. The ball screw 124 is threaded through the slide base 128 on which an attachment plate 130 is fixedly mounted.

Figure 9:
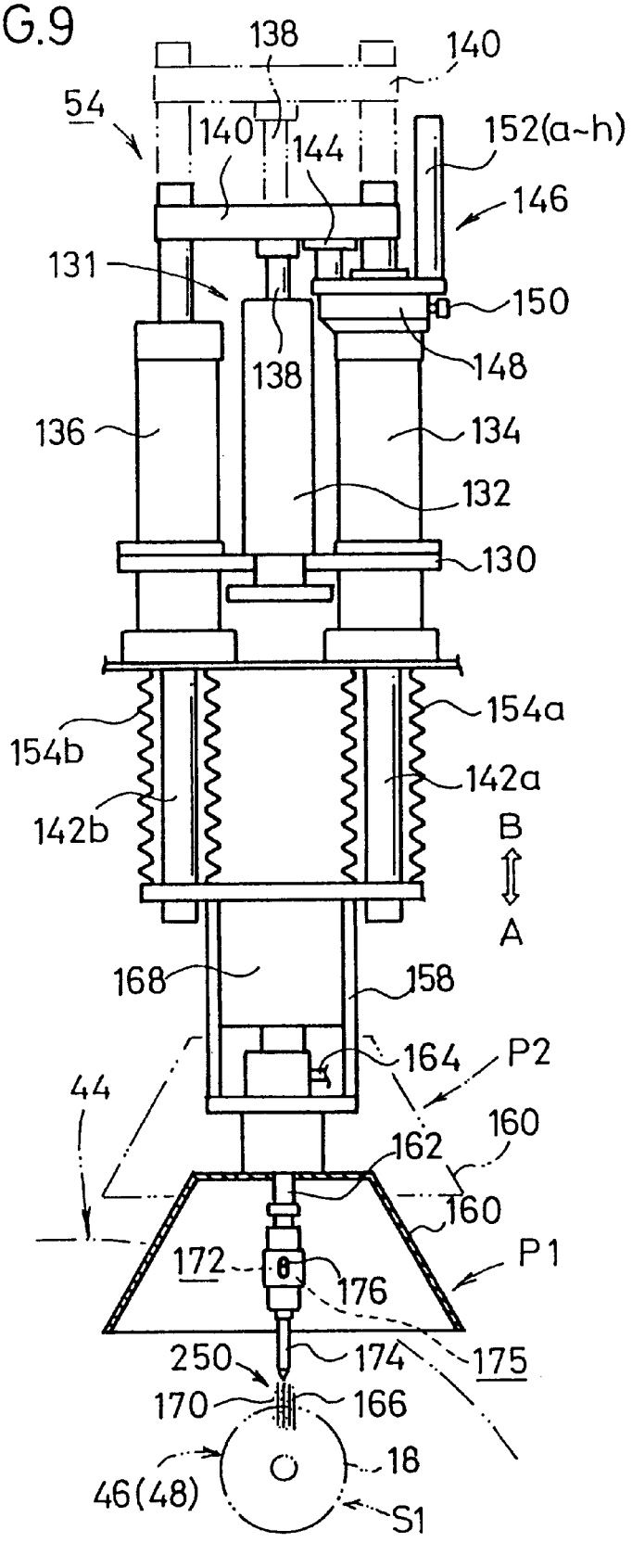
FIG. 9 is a front elevational view of the impelling mechanism.
Figure 10:
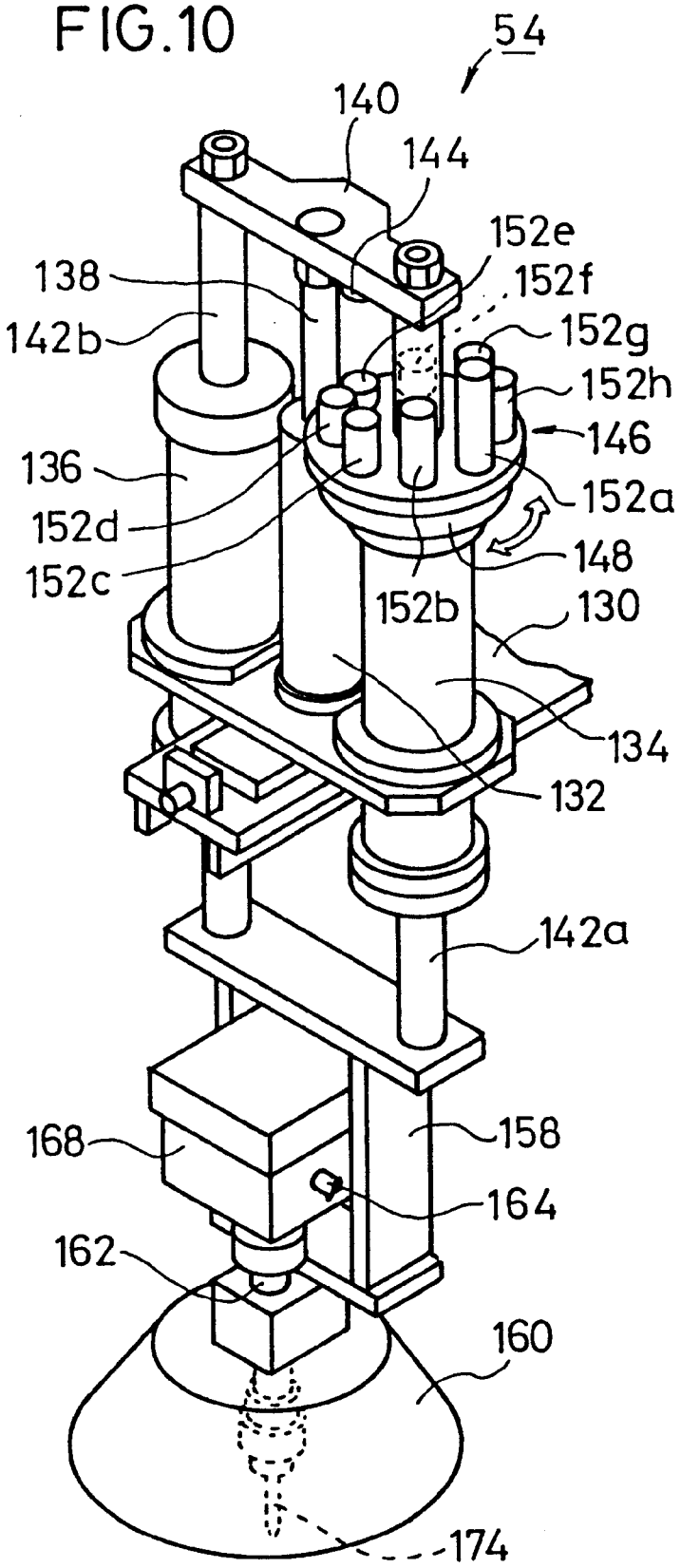
FIG. 10 is a perspective view of the impelling mechanism.

As shown in FIGS. 9 and 10, an actuator unit 131 has a cylinder (linear actuator) 132 whose bottom end is fixed to the attachment plate 130. Two guide sleeves 134, 136 disposed one on each side of and extending parallel to the cylinder 132 are also supported at bottom ends thereof on the attachment plate 130. The cylinder 132 serves to move a nozzle 174 (described in detail later on) between an impelling position P1 (see FIGS. 5 and 9) that is spaced from the gear 18 by a distance required for impelling a mixed stream 250 (described later on), and a retracted position P2 (see also FIGS. 5 and 9) out of physical interference with the partition mechanism 44 as it operates.

The cylinder 132 includes a piston rod 138 extending upwardly and affixed to a joint plate 140 whose opposite ends are secured to respective upper ends of guide rods 142*a*, 142*b*. The guide rods 142*a*, 142*b* are axially slidably inserted through the guide sleeves 134, 136 and have respective lower portions extending downwardly from the guide sleeves 134, 136. An abutment seat 144 is fixed to a lower surface of the joint plate 140, and a nozzle position adjusting unit 146 is mounted on an upper end of the guide sleeve 134 for coaction with the abutment seat 144.

As shown in FIG. 10, the nozzle position adjusting unit 146 includes a disk-shaped rotor 148 angularly movably disposed on the upper end of the guide sleeve 134. The rotor 148 can be locked in a desired angular position with respect to the guide sleeve 134 by a setscrew 150 (see FIG. 9). The rotor 148 supports thereon a plurality of (eight, for example) stoppers 152*a*–152*h* at angularly equally spaced intervals around the center of the rotor 148. The stoppers 152*a*–152*h* are in the form of vertical cylindrical rods having different lengths, and one at a time of the stoppers 152*a*–152*h* will be abut against the abutment seat 144 for selectively positioning the nozzle 174 in its axial position depending on the shape of the gear 18.

The lower portions of the guide rods 142*a*, 142*b* which project downwardly from the guide sleeves 134, 136 are covered with respective bellows protectors 154*a*, 154*b*, and are inserted into the processing chamber 40 through an oblong hole 156 (see FIG. 3) which is defined in the casing 14, the oblong hole 156 being elongate in the direction indicated by the arrow X. A support base 158 is fixed to the lower ends of the guide rods 142*a*, 142*b*, and a downwardly open frustoconical protective cover 160 is supported on a lower end of the support base 158.

As shown in FIG. 9, a vertical tube 162 is mounted on the support base 158 and has an upper end connected to a conduit 164 connected to a high-pressure pump (not shown) for supplying water under pressure. An on-off valve 168 is supported on the support base 158 for selectively opening and closing the conduit 164 to introduce and stop water 166 from the high-pressure pump. A mixing chamber 172 for mixing the water 166 with glass beads 170 is connected to a lower end of the tube 162 within the protective cover 160. The nozzle 174 is connected to a lower end of the mixing chamber 172. The mixing chamber 172 has a glass beads inlet 175 which is open in a direction across the flow of the water 166 in the mixing chamber 172. The glass beads inlet 175 is connected through a tube 176 to a glass beads supply mechanism 178 (see FIGS. 1, 11–13).

Figure 11:
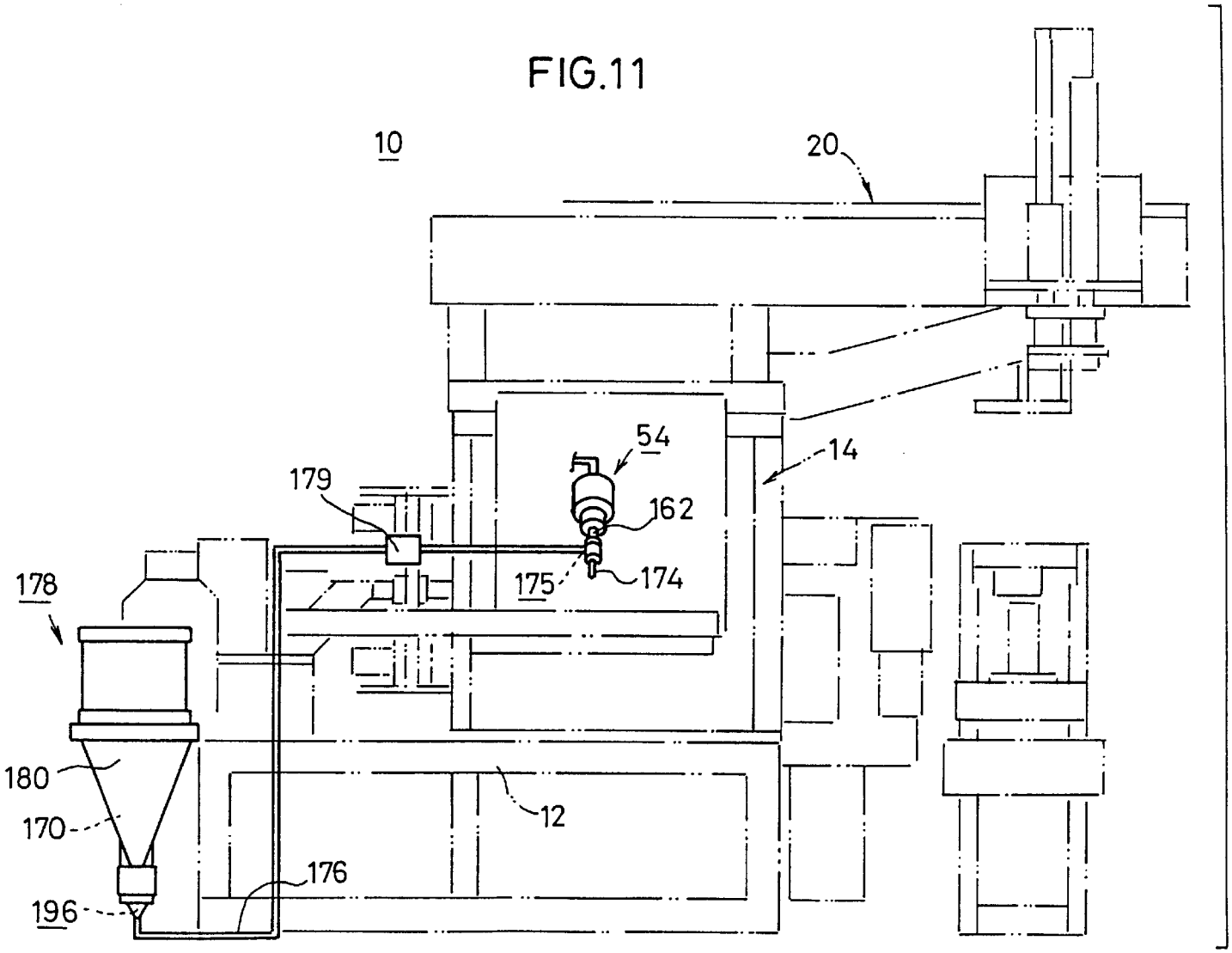
FIG. 11 is a front elevational view showing a glass beads supply mechanism of the apparatus.
Figure 12:
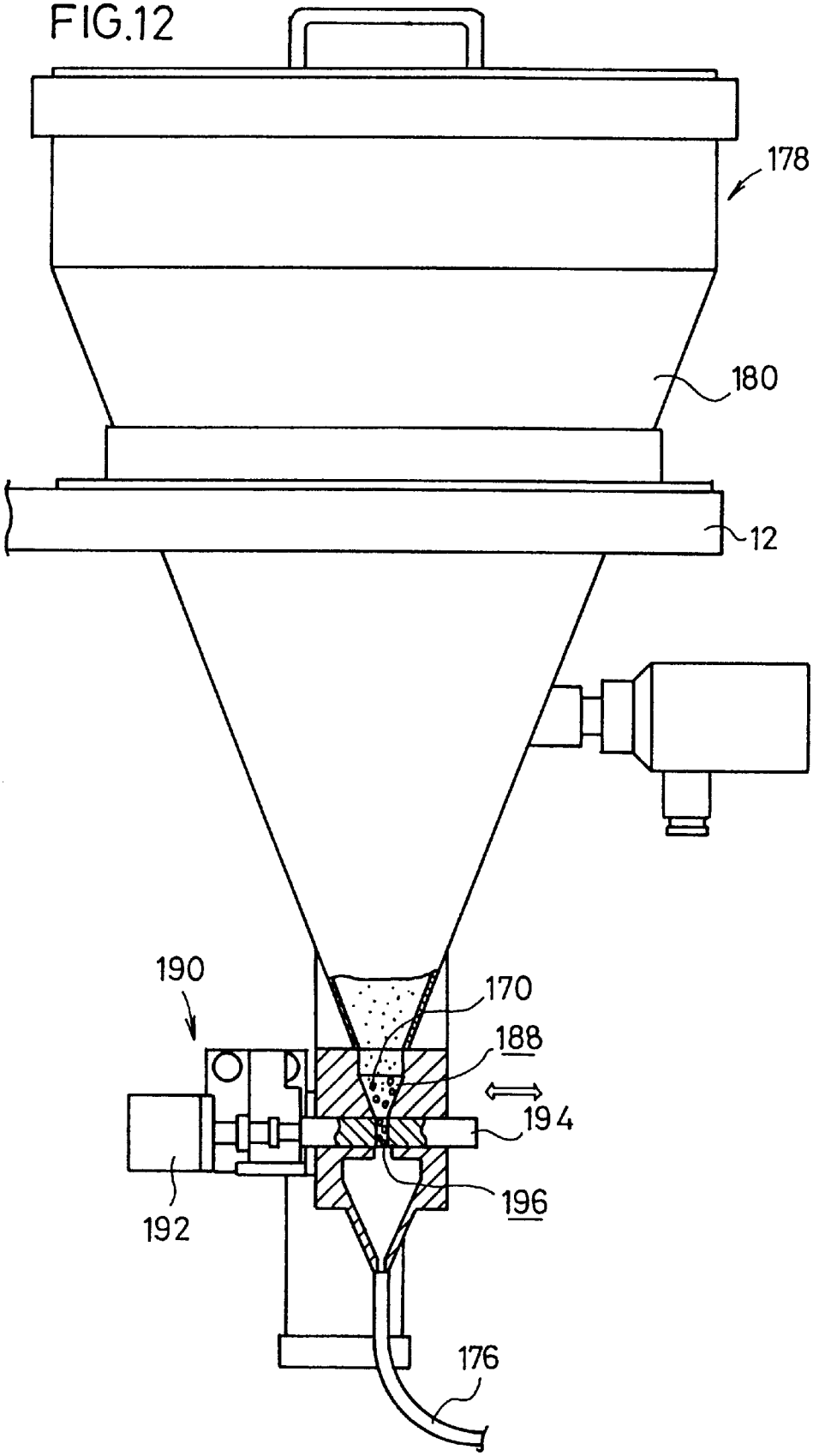
FIG. 12 is a front elevational view, partly in cross section, of a glass beads supply unit of the apparatus.
Figure 13:
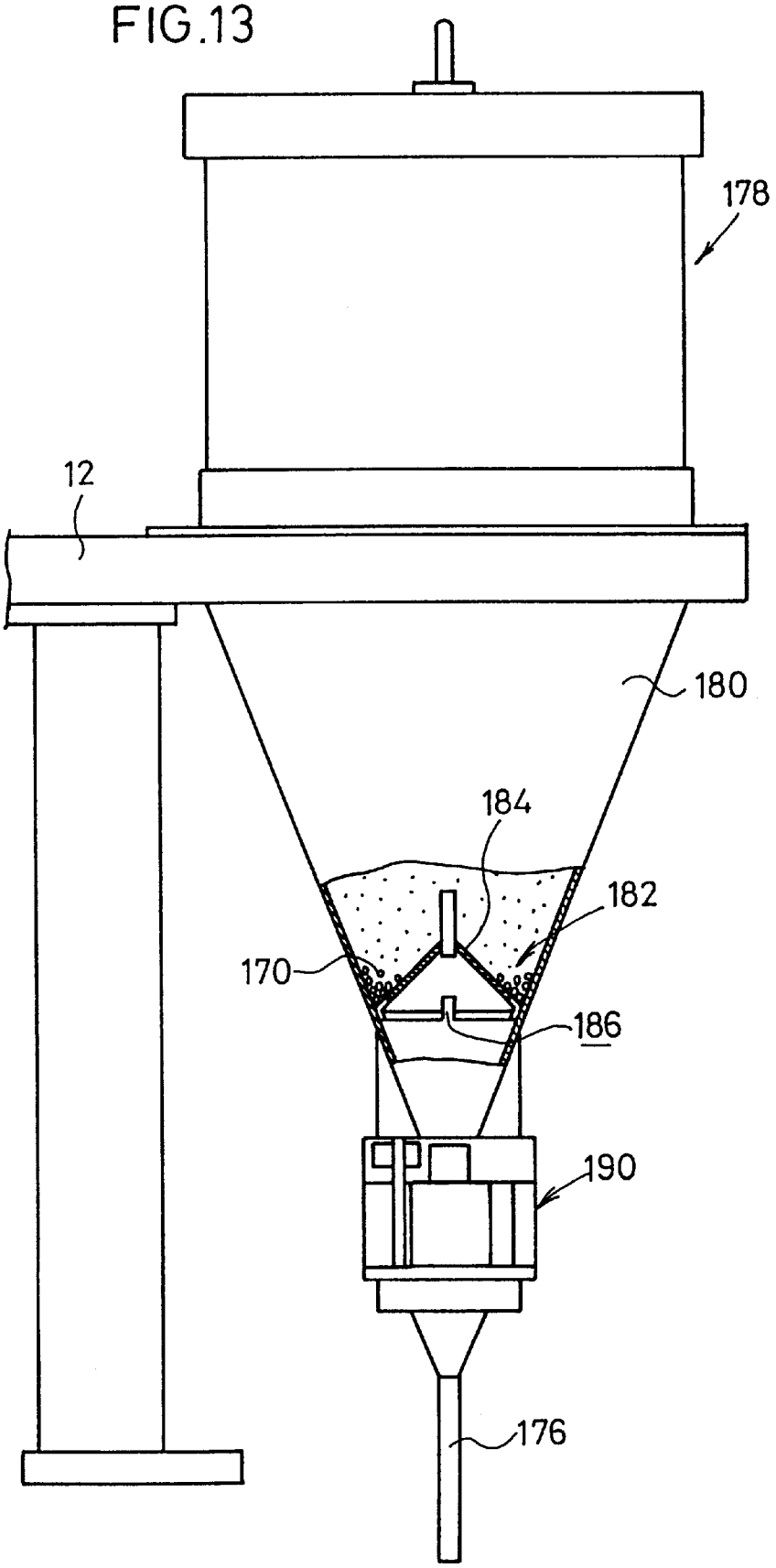
FIG. 13 is a side elevational view, partly in cross section, of the glass beads supply unit.

As shown in FIGS. 11–13, the glass beads supply mechanism 178 has a hopper 180 mounted on the base 12 for storing glass beads. The hopper 180 is disposed in a relatively low position with respect to the base 12, and has a funnel shape whose diameter is progressively smaller in the downward direction. The hopper 180 houses therein a limiter 182 positioned near its lower end. The limiter 182 has a conical surface 184 whose central area projects upwardly. The conical surface 184 has a plurality of openings 186 defined in its lower end at certain spaced intervals for delivering glass beads downwardly therethrough at a constant rate.

The lower end of the hopper 180 is connected to a downwardly tapered passage 188 positioned below the limiter 182. Beneath the passage 188, there is disposed a gate unit 190 which includes an actuator 192 such as a solenoid and a horizontal rod 194 horizontally movably connected to the actuator 192. The rod 194 has a vertical through hole 196 defined as a glass beads outlet therein which connects the passage 188 to the tube 176 when the rod 194 is horizontally displaced by the actuator 192.

As shown in FIG. 11, the glass beads inlet 175 of the impelling mechanism 54 is connected by the tube 176 to the glass beads outlet 196 of the glass beads supply mechanism 178. The glass beads outlet 196 is located in a position lower than the glass beads inlet 175. A laser flowmeter 179 is connected to the tube 176 for detecting the rate at which glass beads 170 flow through the tube 176.

As shown in FIGS. 5 and 6, the washing liquid supply mechanism 56 has a water pipe 200 fixed to an inner wall surface of the casing 14. The water pipe 200 has water outlets 202 for ejecting washing water toward the gear 18 disposed in the processing chamber 40. The water outlets 202 communicate with a washing liquid source (not shown) through the water pipe 200 and a plurality pipes 204 connected thereto.

As shown in FIGS. 5 and 6, the fixed drying mechanism 58 has an air pipe 206 fixed to an inner wall surface of the casing 14. The air pipe 206 has a plurality of circumferentially spaced arrays of axially spaced air nozzles 208. The air pipe 206 is connected to a plurality of pipes 210 which are connected to a drying air source (not shown).

As shown in FIGS. 1, 3, and 5, a shutter unit 220 for opening and closing a hole 224 defined in an upper area of the drying chamber 42 is mounted on the casing 14. The shutter unit 220 comprises a cylinder 222 fixedly mounted on an upper outer wall surface of the casing 14 and extending in the direction indicated by the arrow X. The shutter unit 220 also has a pair of vertically spaced guide rails 226, 228 mounted on respective outer wall surfaces of the casing 14 above and below the hole 224 and extending parallel to the cylinder 222 in the direction indicated by the arrow X. A shutter 230 in the form of a bent plate is movably mounted on the guide rails 226, 228, and the cylinder 222 has a piston rod 222*a* fixed to the shutter 230. When the cylinder 222 is actuated, the shutter 230 is moved by the piston rod 222*a* along the guide rails 226, 228 to open or close the hole 224.

As shown in FIG. 3, a mist retriever 240 is mounted on a side of the base 12. The mist retriever 240 is connected to an end of a duct 242 whose other end is connected to an upper portion of the casing 14 above the processing chamber 40.

Operation of the apparatus 10 will be described below.

As shown in FIGS. 1 through 3, the slide base 24 of the feed mechanism 20 is positioned above the workpiece conveyor 16, and a gear 18 which has been processed, i.e., peened, and grasped by the discharger 28 is discharged onto the workpiece conveyor 16. A blank gear 18 which is to be processed or peened is picked up from the workpiece conveyor 16 and grasped by the charger 26. The blank gear 18 has been machined to gear shape and carburized.

Then, the slide base 24 is moved along the guide rails 22 to a position above the casing 14. The cylinder 222 of the shutter unit 220 operates to move the shutter 230 to open the hole 224, and the cylinder 32 of the discharger 28 is actuated to move the discharging gripper 36 into the drying chamber 42. The discharging gripper 36 grips a processed gear 18 held by the first holder mechanism 46, and takes the gripped gear 18 out of the drying chamber 42. Thereafter, the cylinder 30 of the charger 26 is actuated to move the charging gripper 34 into the drying chamber 42, allowing the blank gear 18 gripped thereby to be held by the first holder mechanism 46. The charging gripper 34 is displaced away from the casing 14, and the slide base 24 is moved back to a position over the workpiece conveyor 16.

The cylinder 222 is actuated again to move the shutter 230 along the guide rails 226, 228, closing the hole 224. The motor 60 of the partition mechanism 44 is energized to cause the shaft 62 to turn the turn disk 64 and the shaft 66 in unison with each other through an angle of 180°.

The first holder mechanism 46 is now angularly moved into the blasting station S1 not shown 1–3 in the processing chamber 40. A processed gear 18 which is held by the second holder mechanism 48 is now moved into the drying station S2 in the drying chamber 42. In the processing chamber 40, as shown in FIG. 6, the piston 78 of the actuator mechanism 72 is displaced in the direction indicated by the arrow X1 to connect the coupling 80 to the first holder mechanism 46.

While the turn disk 64 is turning, the nozzle 174 of the impelling mechanism 54 is in the retracted position P2 indicated by the two-dot-and-dash lines in FIGS. 5 and 9. When the turn disk 64 stops, the cylinder 132 is actuated to displace the piston rod 138 and the guide rods 142*a*, 142*a* in the direction indicated by the arrow A. Therefore, the nozzle 174 is displaced with the support base 158 also in the direction indicated by the arrow A, from the retracted position P2 to the impelling position P1.

The rotary actuator 74 of the actuator mechanism 72 is operated to rotate the blank gear 18 held by the first holder mechanism 46 in a given direction in the processing chamber 40. In the impelling mechanism 54, the motor 122 of the slide unit 120 is energized to rotate the ball screw 124, moving the slide base 128 in the direction indicated by the arrow Xl (FIG. 8), and the on-off valve 168 is opened.

Water 166 is delivered under pressure from the high-pressure pump through the conduit 164 into the tube 162, from which the water 166 is introduced into the mixing chamber 172 where it develops a negative pressure in the glass beads inlet 175. Glass beads 170 are now drawn from the hopper 180 through the tube 176 and the glass beads inlet 175 into the mixing chamber 172 where the glass beams 170 are mixed with the water 166. A mixed stream 250 of the glass beams 170 and the water 166 is impelled from the nozzle 174 toward the gear 18.

Figure 14:
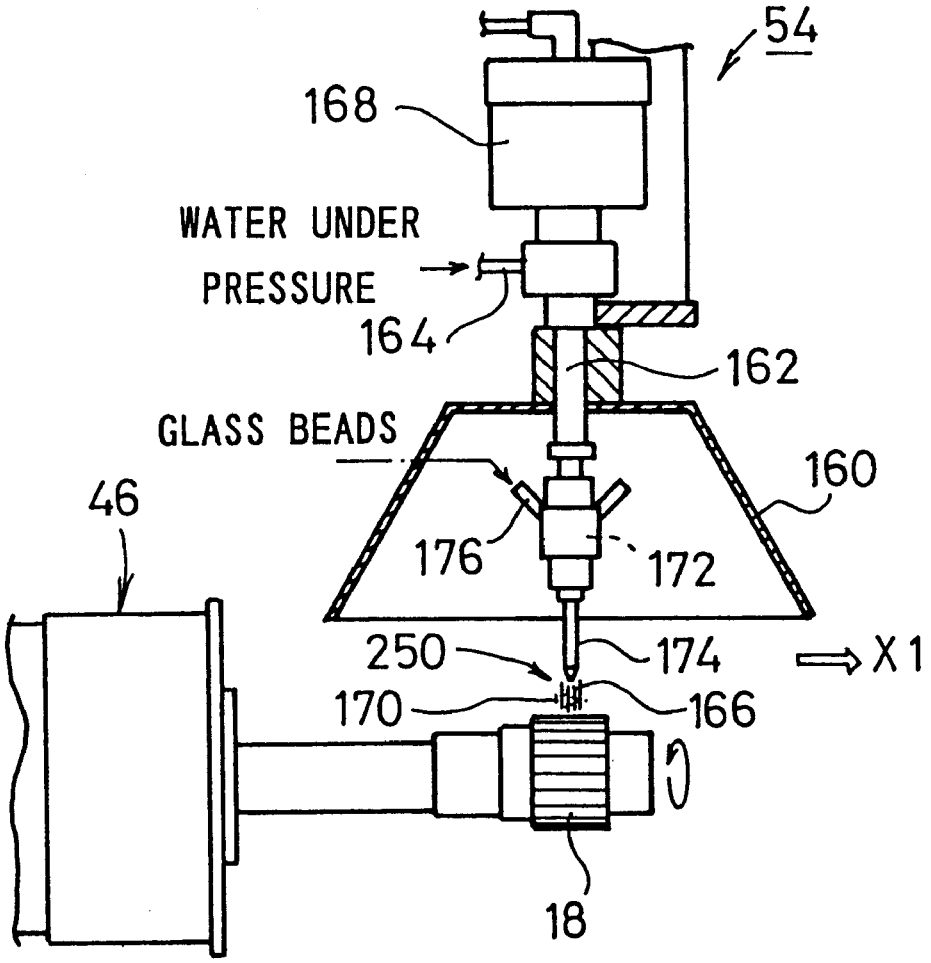
FIG. 14 is a cross-sectional view illustrative of the manner in which the impelling mechanism operates.

As shown in FIG. 14, the mixed stream 250 strikes the rotating gear 18 with a definite directivity pattern. At this time ,the nozzle 174 moves axially of the gear 18 in the direction indicated by the arrow X1 at a certain speed. Therefore, the mixed stream 250 is applied accurately to a desired position on the gear 18 within a short period of time, imparting desired compressing residual stresses to the gear 18. When the mixed stream 250 hits the gear 18, the glass beads 170 contained therein are crushed, flattening the surface of the gear 18.

After the gear 18 is peened by the impelling mechanism 54, as shown in FIG. 5, washing water is supplied from the pipes 204 to the water pipe 200, and ejected from the water outlets 202 to the gear 18. The washing water applied to the gear 18 removes crushed debris of the glass beads 170 and chips of the gear 18 from the gear 18.

After the gear 18 is washed in the processing chamber 40, the cylinder 132 of the impelling mechanism 54 is actuated to displace the piston rod 138 to the two-dot-and-dash-line position in FIGS. 5 and 9, moving the nozzle 174 from the impelling position P1 back to the retracted position P2.

The motor 60 is actuated to turn the turn disk 64 and the shaft 66 in unison with the shaft 62 through 180°. Therefore, as shown in FIG. 5, the first holder mechanism 46 which is holding the processed gear 18 is brought into the drying chamber 42. The second holder mechanism 48, which has held a new blank gear 18 transferred from the feed mechanism 20 while the gear 18 is being processed in the processing chamber 40, now brings the blank gear 18 into the processing chamber 40 with the partition mechanism 44.

In the drying chamber 42, the first drying mechanism 50 and the fixed drying mechanism 58 are actuated. Specifically, as shown in FIG. 7, drying air under pressure is supplied to the air ports 106 of the fixed member 104. The supplied drying air is supplied through the air passage 98 only to the first drying mechanism 50 which is positioned in the drying chamber 42. The drying air is delivered through the air supply pipe 94 to the pip e 90 of the first drying air supply 84. Thereafter, the drying air is ejected from the air nozzles 92 toward the gear 18 held by the first holder mechanism 46, and from the pipe 110 of the second drying air supply 86 through the air nozzles 112 to the same gear 18.

The fixed drying mechanism 58 is also supplied with drying air under pressure. The supplied drying air under pressure is ejected from the air nozzles 208 toward the gear 18 held by the first holder mechanism 46. Therefore, the washed gear 18 is dried smoothly and quickly by the first drying mechanism 50 and the fixed drying mechanism 58.

In the processing chamber 40, at this time, the gear 18 held by the second holder mechanism 48 is being processed by the mixed stream 250. Therefore, a mist containing crushed debris of glass beads 170 is suspended in the processing chamber 40. Since the drying air under pressure which is ejected from the first drying mechanism 50 and the fixed drying mechanism 58 is developing a higher pressure in the drying chamber 42 than in the processing chamber 40, the pressure in the drying chamber 42 effectively prevents the mist from flowing from the processing chamber 40 into the drying chamber 42.

After the gear 18 is dried in the drying chamber 42, the shutter 230 is moved to opening the hole 224 in the casing 14. The discharger 28 and the charger 26 are successively introduced through the hole 224 into the drying chamber 42, and remove the dried gear 18 from the second holder mechanism 48 and transfer a new blank gear 18 to the second holder mechanism 48.

The first holder mechanism 46 which holds the gear 18 in the drying chamber 42 is brought into the processing chamber 40 as the partition mechanism 44 turns, and the gear 18 processed by the mixed stream 250 and then washed in the processing chamber 40 is held by the second holder mechanism 48, and thereafter brought into the drying chamber 42. In the processing chamber 40, the gear 18 is processed by the impelling mechanism 54. At the same time, the processed gear 18 in the drying chamber 42 is dried by drying air under pressure which is ejected from the first drying mechanism 50 and the fixed drying mechanism 58.

Accordingly, the processed gear 18 is not taken out of the casing 14 from the processing chamber 40 while the mist is being suspended in the processing chamber after the mixed stream 250 is impelled from the impelling mechanism 54 to the gear 18. As a result, no mist flows out of the casing 14 into the surrounding working environment. It is not necessary to keep the processed gear in the processing chamber 40 until the mist is completely removed by the mist retriever 240.

A peening process effected by the impelling mechanism 54, a washing process effected by the washing liquid supply mechanism 56, and a drying process effected by the first and second drying mechanisms 50, 52 and the fixed drying mechanism 58 can thus successively be carried out, thus greatly shortening a cycle time. Since all the above processes are carried out in the casing 14, the apparatus 10 can be simplified in overall structure and reduced in size.

While the gear 18 is being peened by the mixed stream 250 and then washed by the washing liquid supply mechanism 56 in the processing chamber 40, another washed gear 18 is dried and then discharged in the drying chamber 42 and a new blank gear 18 is introduced into the drying chamber 42. As a consequence, the apparatus 10 contributes to an increased rate of production of gears 18.

In the illustrated embodiment, the partition mechanism 44 which defines the processing chamber 40 and the drying chamber 42 has the turn disk 64 which supports the first and second holder mechanisms 46, 48 and which turns in increments of 180°, and the partition plates 68, 69 mounted on the shaft 66 with the first drying mechanism 50 mounted on the surfaces 68*a*, 69*a* and the second drying mechanism 52 mounted on the surfaces 68*b*, 69*b*, the partition plates 68, 69 being rotatable in unison with the turn disk 64. The partition mechanism 44 is relatively simple in overall structure, and hence the apparatus 10 which incorporates the partition mechanism 44 is also relatively simple in overall structure.

As shown in FIG. 11, the hopper 180 of the glass beads supply mechanism 178 is located in a relatively low position with respect to the base 12. The glass beads outlet 196 of the glass beads supply mechanism 178 is connected to the glass beads inlet 175 of the impelling mechanism 54 by the tube 176. The glass beads outlet 196 is lower in position than the glass beads inlet 175.

Therefore, even when the a mount of glass beads 170 stored in the hopper 180 fluctuates, glass beads 170 can be supplied at a constant rate to the impelling mechanism 54. When a negative pressure is developed in the glass beads inlet 175 connected to the mixing chamber 172 due to the water 166 introduced under pressure from the conduit 164 to the tube 162, therefore, the glass beads 170 are drawn accurately at a certain rate into the mixing chamber 172 under the negative pressure.

The mixing chamber 172 is thus reliably supplied with glass beads 170 at a constant rate at all times. The glass beads 170 and the water 166*b* are mixed with each other in the mixing chamber 172, an d a mixed stream 250 containing glass beads 170 at a constant rate is impelled from the nozzle 174 to the gear 18. As a result, the mixed stream 250 can give desired compressive residual stresses to the surface of th e gear 18, and smoothly flattens the surface of the gear 18.

As described above, the hopper 180 of the glass beads supply mechanism 178 is located in a relatively low position with respect to the base 12. Therefore, the hopper 180 can easily be replenished with glass beads 170, and it is easy to increase the volume of the hopper 180 in an upward direction. It is thus possible to store a large quantity of glass beads 170 in the hopper 180, so that the hopper 180 can be replenished with glass beads 170 less frequently and the apparatus 10 can be handled with greater ease.

As shown in FIGS. 5 and 9, when the cylinder 132 of the impelling mechanism 54 is in its backward stroke end in the direction indicated by the arrow A, the nozzle 174 is placed in the impelling position P1 for effectively impelling the mixed stream 250 toward the gear 18 in the blasting station S1, and when the cylinder 132 of the impelling mechanism 54 is in its forward stroke end in the direction indicated by the arrow B, the nozzle 174 is placed in the retracted position P2 out of physical interference with the partition mechanism 44 as it operates. It is not necessary to individually provide a mechanism for positioning the nozzle 174 with respect to the gear 18 and a mechanism for retracting the gear 18 out of physical interference with the partition mechanism 44 as it operates. Only the single cylinder 132 is sufficient to move the nozzle 174 between the impelling position P1 and the retracted position P2.

Consequently, the overall structure of the impelling mechanism 54 is highly simple. The gears 18 as they are held by the first and second holder mechanisms 46, 48 are automatically delivered into the blasting station S1 and the drying station S2 by the partition mechanism 44. The entire process of the apparatus 10 can thus easily be automated.

For processing gears 18 of different types, it is necessary to adjust the position of the nozzle 174 depending on the shape, particularly the diameter, of those gears because the nozzle 174 needs to be spaced appropriately from the surface of the gear 18 to be processed for give a high-quality surface treatment to the gear 18.

In the illustrated embodiment, the nozzle position adjusting unit 146 of the impelling mechanism 54 has the disk-shaped rotor 148 (see FIGS. 9 and 10) rotatably mounted on the upper end of the guide sleeve 134. To adjust the position of the nozzle 174, the setscrew 150 is loosened, and then the rotor 148 is turned to bring one of the stoppers 152*a*–152*h*, e.g., the longest stopper 152*a*, into vertical alignment with the abutment seat 144 on the joint plate 140. Then, the setscrew 150 is tightened to lock the rotor 148 to the upper end of the guide sleeve 134.

Figure 15:
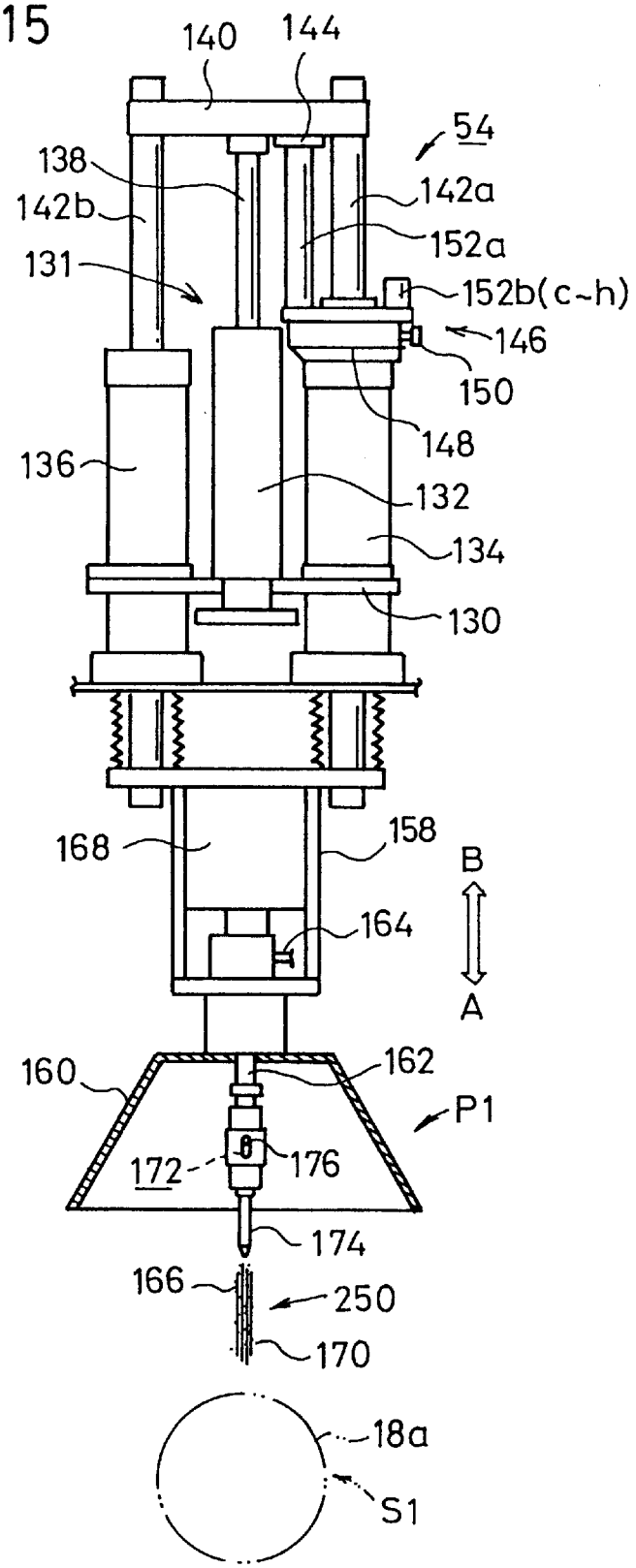
FIG. 15 is a front elevational view of a nozzle position adjusting unit of the impelling mechanism.

Thereafter, as shown in FIG. 15, the cylinder 132 is operated to displace the piston rod 138 in the direction indicated by the arrow A until the longest stopper 152*a* abuts against the abutment seat 144. The nozzle 174 is now spaced a suitable distance from the outer circumferential surface of a gear 18*a* having a large diameter, and can impel the mixed stream 250 effectively to the gear 18*a*.

The nozzle 174 can thus be brought into the impelling position P1 spaced a desired distance from different gears 18 (18*a*) simply by rotating the rotor 148 and selectively positioning the stoppers 152*a*–152*h* in alignment with the abutment seat 144. Accordingly, the nozzle 174 can be positioned easily and appropriately with respect to a variety of different gears 18 (18*a*). The apparatus 10 can process gears 18 to give a high-quality surface finish to them, and is highly versatile as it can process a variety of different gears 18 (18*a*). The nozzle position adjusting unit 146 is relatively simple in structure as it comprises only the rotor 134 having the stoppers 152*a*–152*h* of different lengths.

As described above, the apparatus according to the present invention includes the processing chamber having the impelling mechanism for impelling a mixed stream of glass beads and a liquid toward a metal component, and the drying chamber having the drying mechanisms for drying the metal component to which the mixed stream has been applied, with the metal component being attachable to and detachable from the holder mechanisms in the drying chamber. The holder mechanisms which holds metal components are successively brought into the processing chamber and the drying chamber by the partition mechanism as it is angularly moved, for successively carrying out peening, washing, and drying processes. A mist containing crushed fragments of the glass beads can reliably be prevented from flowing out of the casing, and the cycle time of the apparatus can be greatly reduced. The apparatus is of a relatively simple structure and contributes to an increased rate of production of metal components.

Inasmuch as the glass beads outlet of the glass beads supply mechanism is located in a relatively low position with respect to the glass beads inlet of the impelling mechanism, glass beads can be supplied to the impelling mechanism reliably at a constant rate without being adversely affected by fluctuations in the quantity of glass beads stored in the glass beads supply mechanism.

Since the height of the glass beads supply mechanism is relatively small, the glass beads supply mechanism can easily be handled and the volume of a storage space in the glass beads supply mechanism can be increased in an upward direction.

Furthermore, the nozzle for impelling a mixed stream of glass beads and a liquid toward a metal component is placed in an impelling position suitable for impelling the mixed stream when the actuator of the nozzle is in one stroke end, and is placed in a retracted position out of physical interference with the feed mechanism when the actuator of the nozzle is in an opposite stroke end. Therefore, the single actuator is capable of bringing the nozzle selectively into the impelling position and the retracted position with a simple arrangement. Because the metal component can automatically be fed, the entire process of the apparatus can easily be automated.

Although a certain preferred embodiment of the present invention has been shown and described in detail, it should be understood that various changes and modifications may be made therein without departing from the scope of the appended claims.

What is claimed is:

1. An apparatus for increasing the strength of a surface of a metal component, comprising:

holder mechanisms for holding a metal component;

an impelling mechanism for impelling a mixed stream of glass beads and a liquid toward the metal component to increase the strength of a surface of the metal component;

drying mechanisms for drying the metal component to which the mixed stream has been applied;

a casing having therein a processing chamber with said impelling mechanism disposed therein and a drying chamber with said drying mechanism disposed therein, for allowing the metal components to be attached to and detached from said holder mechanisms; and a partition mechanism dividing said processing chamber and said drying chamber from each other, and angularly movable for bringing said holder mechanisms into said processing chamber and said drying chamber, wherein said drying mechanisms comprise respective pairs of drying air supplies mounted on and angularly movable in unison with said partition mechanism, and positionable alternately in said processing chamber and said drying chamber.

2. An apparatus according to claim 1, wherein said drying mechanisms further comprise an air switching unit for supplying drying air only to the drying air supplies which are placed in said drying chamber.

3. An apparatus according to claim 2, wherein said drying air supplies comprise means for drying the metal component in said drying chamber and ejecting said drying air as air under pressure to prevent a mist in said processing chamber from entering said drying chamber.

4. An apparatus according to claim 1, wherein said partition mechanism comprises:

a turn member rotatable by a rotary actuator, said holder mechanisms being mounted on said turn member; and partition plates mounted on said turn member and dividing said processing chamber and said drying chamber from each other.

5. An apparatus according to claim 1, wherein said processing chamber has a washing liquid supply mechanism for supplying a washing liquid to wash the metal component to which the mixed stream has been applied.

6. An apparatus according to claim 1, further comprising an actuator mechanism coupled to said holder mechanisms disposed in said processing chamber, for rotating said holder mechanisms.

7. An apparatus according to claim 1, wherein said drying chamber houses a fixed drying mechanism for drying the metal component therein.

8. An apparatus according to claim 1, further comprising:

a shutter unit mounted on said casing for selectively opening a hole defined in said casing above said drying chamber; and a charger for charging the metal component and a discharger for discharging the metal component, said charger and said discharger being movable into said hole when the hole is opened by said shutter unit.

9. An apparatus according to claim 1, wherein said metal component comprises a heat-treated gear.

10. An apparatus for increasing the strength of a surface of a metal component, comprising:

holder mechanisms for holding a metal component in a blasting station;

an impelling mechanism for impelling a mixed stream of glass beads and a liquid toward the metal component in said blasting station to increase the strength of a surface of the metal component; and a feed mechanism for bringing the metal component into said blasting station and bringing the metal component out of said blasting station after the mixed stream is applied to the metal component;

said impelling mechanism comprising:

a nozzle for impelling said mixed stream toward the metal component; and an actuator unit comprising a linear actuator for moving said nozzle in a linear direction selectively to an impelling position spaced from the metal component by a distance required to impel the mixed stream to the metal component in said blasting station, and a retracted position out of physical interference with said feed mechanism as it operates.

11. An apparatus according to claim 10, wherein said actuator unit has a nozzle position adjusting unit for placing said nozzle selectively in a plurality of positions depending on a variety of different metal components.

12. An apparatus according to claim 11, wherein said nozzle position adjusting unit has a plurality of stoppers of different lengths selectively positionable in a restrictive position for limiting movement of said linear actuator in a predetermined direction.

13. An apparatus according to claim 10, wherein said impelling mechanism has a slide unit for moving said nozzle in a direction perpendicular to a direction in which the mixed stream is impelled.

14. An apparatus according to claim 10, wherein said feed mechanism comprises a partition mechanism defining a processing chamber with said impelling mechanism disposed therein and a drying chamber with drying mechanisms disposed therein, for allowing the metal component to be attached to and detached from said holder mechanisms, said partition mechanism being angularly movable for bringing said holder mechanisms into said processing chamber and said drying chamber.

* * * * *

UNITED STATES PATENT AND TRADEMARK OFFICE

CERTIFICATE OF CORRECTION

PATENT NO. : 6,058,584

DATED : May 9, 2000

INVENTOR(S) : Matsuyama et al.

It is certified that error appears in the above-identified patent and that said Letters Patent is hereby corrected as shown below:

On the title page, in item "[73] Assignee:" please change the assignee from "Honda Giken Kabushiki Kaisha, Tokyo, Japan" to -- Honda Giken Kogyo Kabushiki Kaisha, Tokyo, Japan --.

Signed and Sealed this

Tenth Day of April, 2001

*Attest:*

Nicholas P. Godici

NICHOLAS P. GODICI

*Attesting Officer*

*Acting Director of the United States Patent and Trademark Office*